US010821578B2

(12) United States Patent
Hu

(10) Patent No.: US 10,821,578 B2
(45) Date of Patent: Nov. 3, 2020

(54) FOLDING TOOL SET

(71) Applicant: GONG FONG ENTERPRISE CO., LTD., Tainan (TW)

(72) Inventor: Cheng-Te Hu, Tainan (TW)

(73) Assignee: Gong Fong Enterprise Co., Ltd., Tainan (TW)

( * ) Notice: Subject to any disclaimer, the term of this patent is extended or adjusted under 35 U.S.C. 154(b) by 327 days.

(21) Appl. No.: 15/989,643

(22) Filed: May 25, 2018

(65) Prior Publication Data

US 2019/0344409 A1 Nov. 14, 2019

(30) Foreign Application Priority Data

May 9, 2018 (TW) ..... 107206016 U

(51) Int. Cl.
*B25B 23/00* (2006.01)
*B25B 15/00* (2006.01)
*B25G 1/08* (2006.01)

(52) U.S. Cl.
CPC ..... *B25B 23/0007* (2013.01); *B25B 15/008* (2013.01); *B25G 1/085* (2013.01)

(58) Field of Classification Search
CPC ... B25B 23/0007; B25B 15/008; B25B 13/48; B25B 13/481; B25B 13/5091; B25G 1/085; E21B 19/16
See application file for complete search history.

(56) References Cited

U.S. PATENT DOCUMENTS 6,751,819 B2 * 6/2004 Chuang ..... B25B 13/56 157/1.3
6,868,760 B1 * 3/2005 Johnson ..... B25B 13/56 30/161
7,020,923 B1 * 4/2006 Jangula ..... B25B 13/56 7/158

* cited by examiner

*Primary Examiner* — Brian D Keller
(74) *Attorney, Agent, or Firm* — Rosenberg, Klein & Lee

(57) ABSTRACT

A folding tool set includes an accommodating seat, a fixing shaft, many tools, many spacers, and an elastic member. The accommodating seat defines an accommodating space. The fixing shaft is disposed on the accommodating seat and has a polygonal radial section. One end of each tool is formed with a connecting hole through which the fixing shaft passes. The tools are pivotally connected to the fixing shaft and movably accommodated in the accommodating space. The spacers are spaced apart from each other and disposed on the fixing shaft. The spacers each have a through hole. The through hole corresponds in shape to the radial section of the fixing shaft. The elastic member is disposed on the fixing shaft. The elastic member has elasticity in an axial direction of the fixing shaft. When one of the tools is pivoted, the fixing shaft won't be driven to link the other tools.

7 Claims, 6 Drawing Sheets

FOLDING TOOL SET

FIELD OF THE INVENTION

The present invention relates to a folding tool set, and more particularly to a folding tool set that comprises a fixing shaft, a plurality of spacers and an elastic member to cooperate with each other so that a plurality of tools pivotally connected to the fixing shaft won't be linked with each other when being pivoted.

BACKGROUND OF THE INVENTION

In order to allow a variety of tools, such as hexagonal rods of different specifications, etc., to be carried and stored conveniently, a folding tool set is developed on the market. Referring to FIG. 1 and FIG. 2, a conventional folding tool set includes an accommodating seat 101, two fixing shafts 102, a plurality of tools 103, and a plurality of spacers 104. The accommodating seat 101 defines a first accommodating space 105 and a second accommodating space 106. The fixing shafts 102 are insertedly connected to the accommodating seat 101, respectively. Each tool 103 has a pivot hole 107. The tools 103 are pivotally connected to the fixing shafts 102 through the pivot holes 107 respectively and accommodated in the first accommodating space 105 or the second accommodating space 106. The fixing shafts 102 pass through the spacers 104. The spacers 104 are located between any two of the tools 103, so that the tools 103 are separated from each other and do not be affected each other.

However, when in use, the folding tool set 10 has the following disadvantages.

1. When one of the tools 103 is pulled, the tool 103 may easily engage the fixing shaft 102 to drive the fixing shaft 102 to rotate and the spacers 104 located at both sides of the tool 103 are driven to rotate along with the rotation of the fixing shaft 102 and the tool 103. In the case that the fixing shaft 102 and the spacers 104 are all rotated, the other tools 103 adjacent to the tool 103 are also pivoted, resulting in inconvenience in use.

2. In order to make the spacers 104 and the tools 103 not slide arbitrarily on the fixing shaft 102, the spacers 104 and the tools 103 need to be closely fitted during assembly. When the tools 103 are pulled, the tools cannot be pivoted smoothly because of the tight space.

Accordingly, the inventor of the present invention has devoted himself based on his many years of practical experiences to solve these problems.

SUMMARY OF THE INVENTION

In view of the shortcomings of the conventional folding tool set, the primary object of the present invention is to provide a folding tool set that can be pivoted smoothly.

The folding tool set of the present invention comprises an accommodating seat, a fixing shaft, a plurality of tools, a plurality of spacers, and an elastic member.

The accommodating seat defines an accommodating space. The accommodating seat has a polygonal pivot hole. The fixing shaft is disposed on the accommodating seat. The fixing shaft has a polygonal radial section and is engaged with inserting in the polygonal pivot hole. One end of each of the tools is formed with a connecting hole through which the fixing shaft passes. The tools are pivotally connected to the fixing shaft and movably accommodated in the accommodating space. The spacers are spaced apart from each other and disposed on the fixing shaft. The spacers are located between the tools and between the tool adjacent to the accommodating seat and the accommodating seat. The spacers each have a through hole through which the fixing shaft passes. The through hole corresponds in shape to the radial section of the fixing shaft. The elastic member is disposed on the fixing shaft. The elastic member has elasticity in an axial direction of the fixing shaft.

Preferably, the connecting hole has a circular shape.

Preferably, each of the spacers has a tolerance with the fixing shaft according to the size of the through hole.

Preferably, the elastic member is a wave washer, and the fixing shaft passes through the wave washer.

Preferably, the accommodating seat includes a transverse plate and two side plates. The side plates are located at opposite sides of the transverse plate, respectively. The accommodating space includes a first accommodating space and a second accommodating space. The transverse plate includes a first surface and a second surface. The second surface is opposite to the first surface. The first surface and the side plates define the first accommodating space. The second surface and the side plates define the second accommodating space. The fixing shaft includes a first fixing shaft and a second fixing shaft. The first fixing shaft and the second fixing shaft are insertedly connected to the side plates and spaced apart from each other. The tools are divided into a plurality of first tools and a plurality of second tools. The first tools are pivotally connected to the first fixing shaft and accommodated in the first accommodating space. The second tools are pivotally connected to the second fixing shaft and accommodated in the second accommodating space.

Preferably, the folding tool set further comprises a plurality of fixing members. The first fixing shaft and the second fixing shaft pass through the side plates and are coupled to the fixing members, respectively.

Preferably, the tools are tools of different specifications.

According to the above technical features, the present invention achieves the following effects:

1. Through the polygonal radial section of the fixing shaft, the fixing shaft is inserted and engaged with the polygonal pivot holes of the side plates. The radial section of the fixing shaft is in a polygonal shape that is different from the circular shape of the connecting hole. When one of the tools is pivoted, the fixing shaft won't be influenced and driven, and the other tools won't be linked due to the fixing shaft.

2. Through the spacers to be tightly fitted and engaged with the fixing shaft respectively, when one of the tools is pivoted, the spacers won't be influenced and driven and the other tools won't be linked. Each spacer has a tolerance with the fixing shaft according to the size of the through hole, so that when one of the tools is pulled, it will slightly link the adjacent tool to make the pulling smoother.

3. Through the elastic members having elasticity, when the tool is pivoted, more space is available for the tool to be pivoted smoothly.

DETAILED DESCRIPTION OF THE PREFERRED EMBODIMENTS

Embodiments of the present invention will now be described, by way of example only, with reference to the accompanying drawings.

Figure 1:
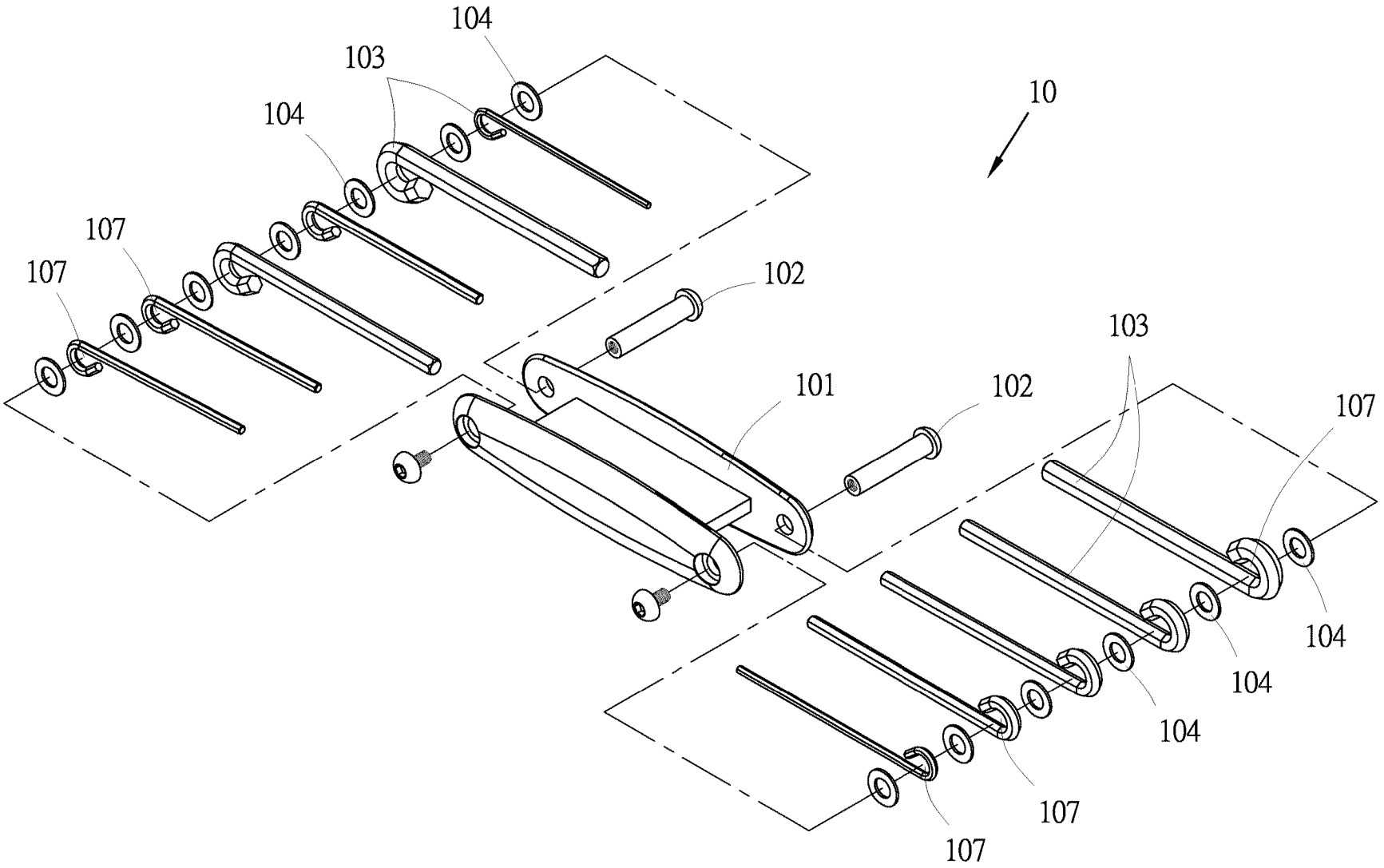
FIG. 1 is an exploded view of a conventional folding tool set.
Figure 2:
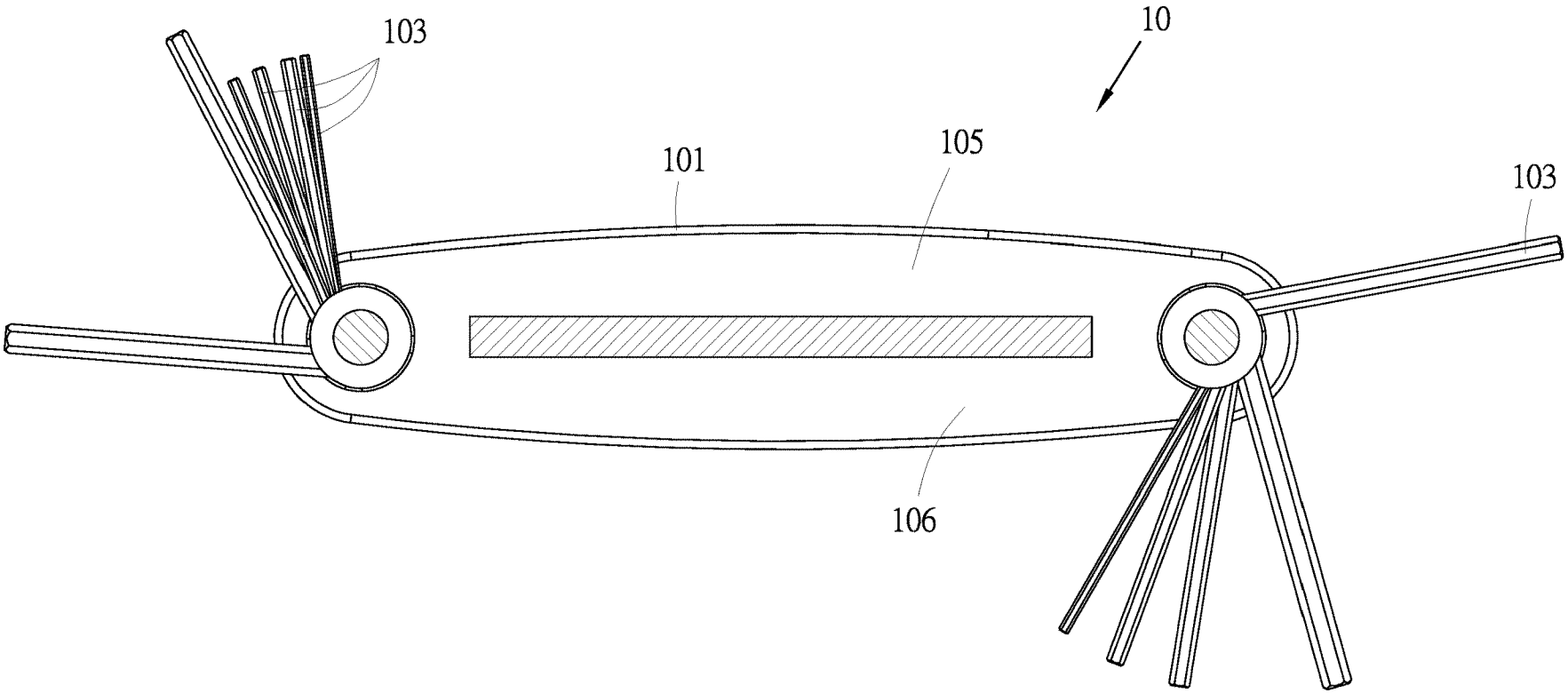
FIG. 2 is a schematic view of the conventional folding tool set when in use.
Figure 3:
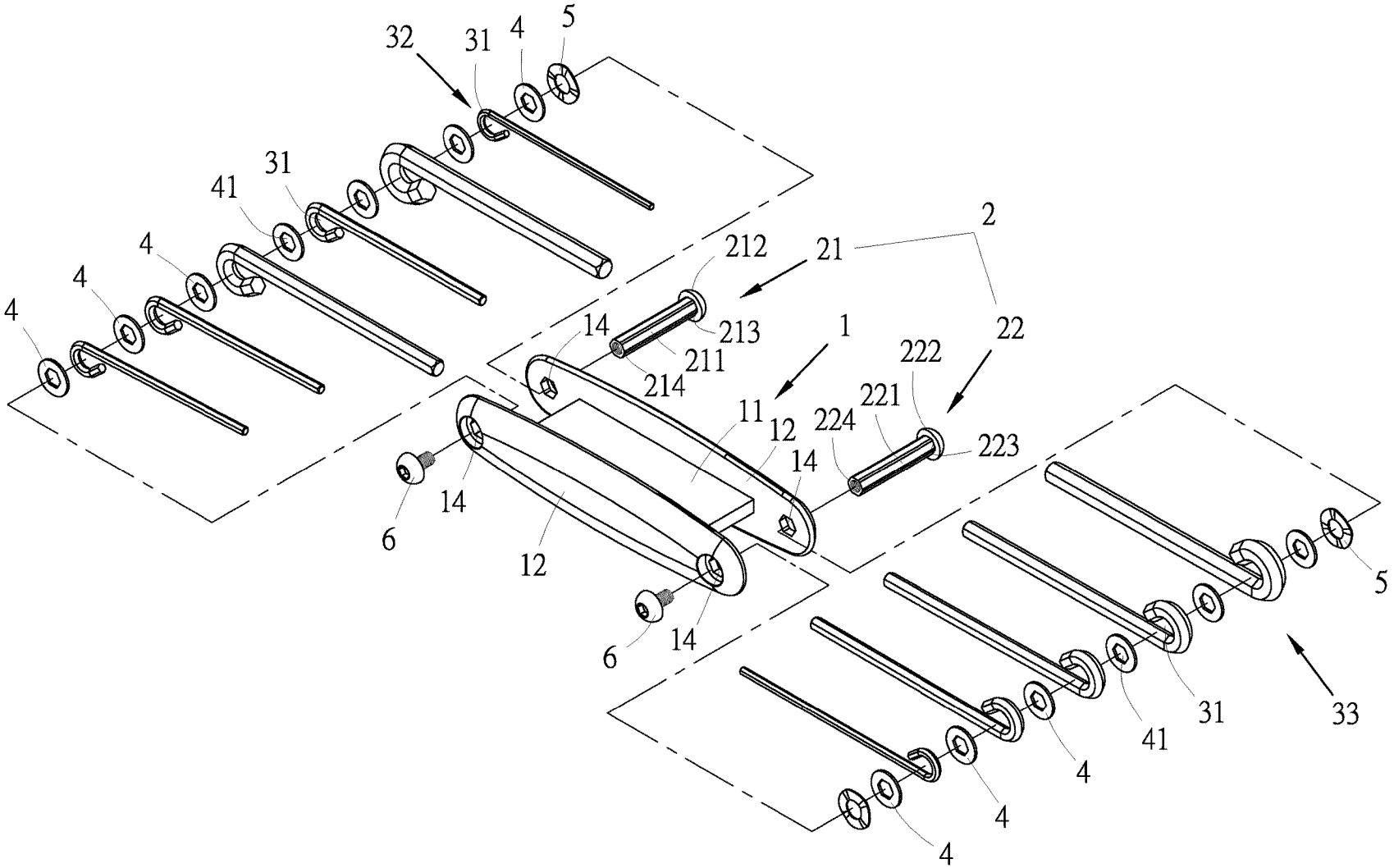
FIG. 3 is an exploded view of a folding tool seat in accordance with an embodiment of the present invention.
Figure 4:
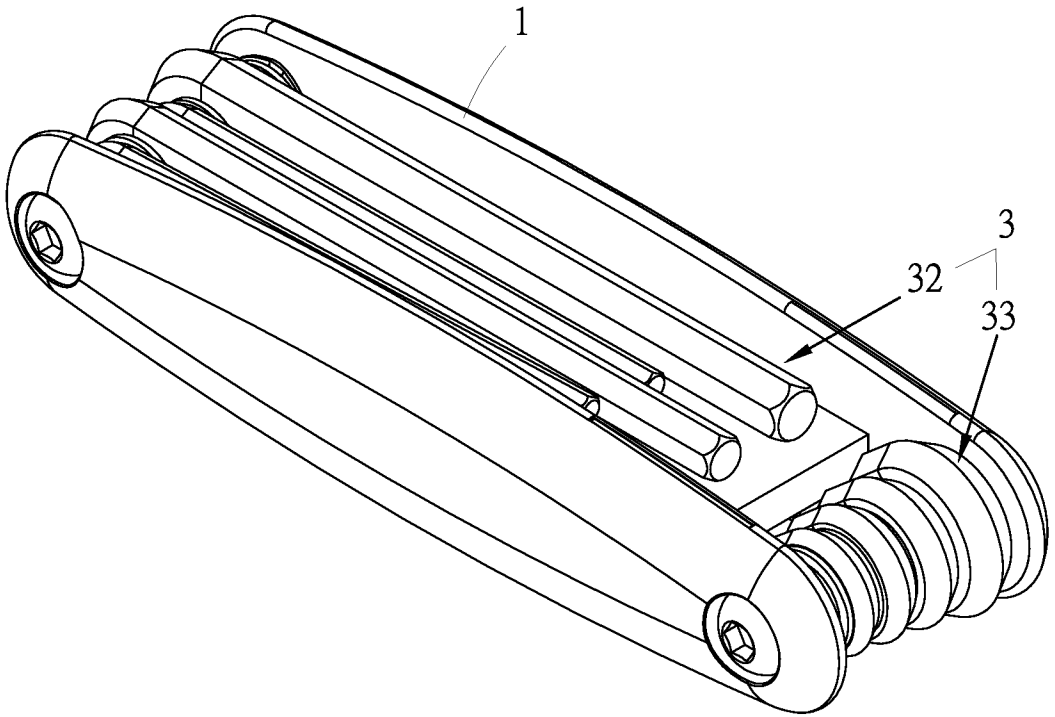
FIG. 4 is a perspective view in accordance with the embodiment of the present invention.
Figure 5:
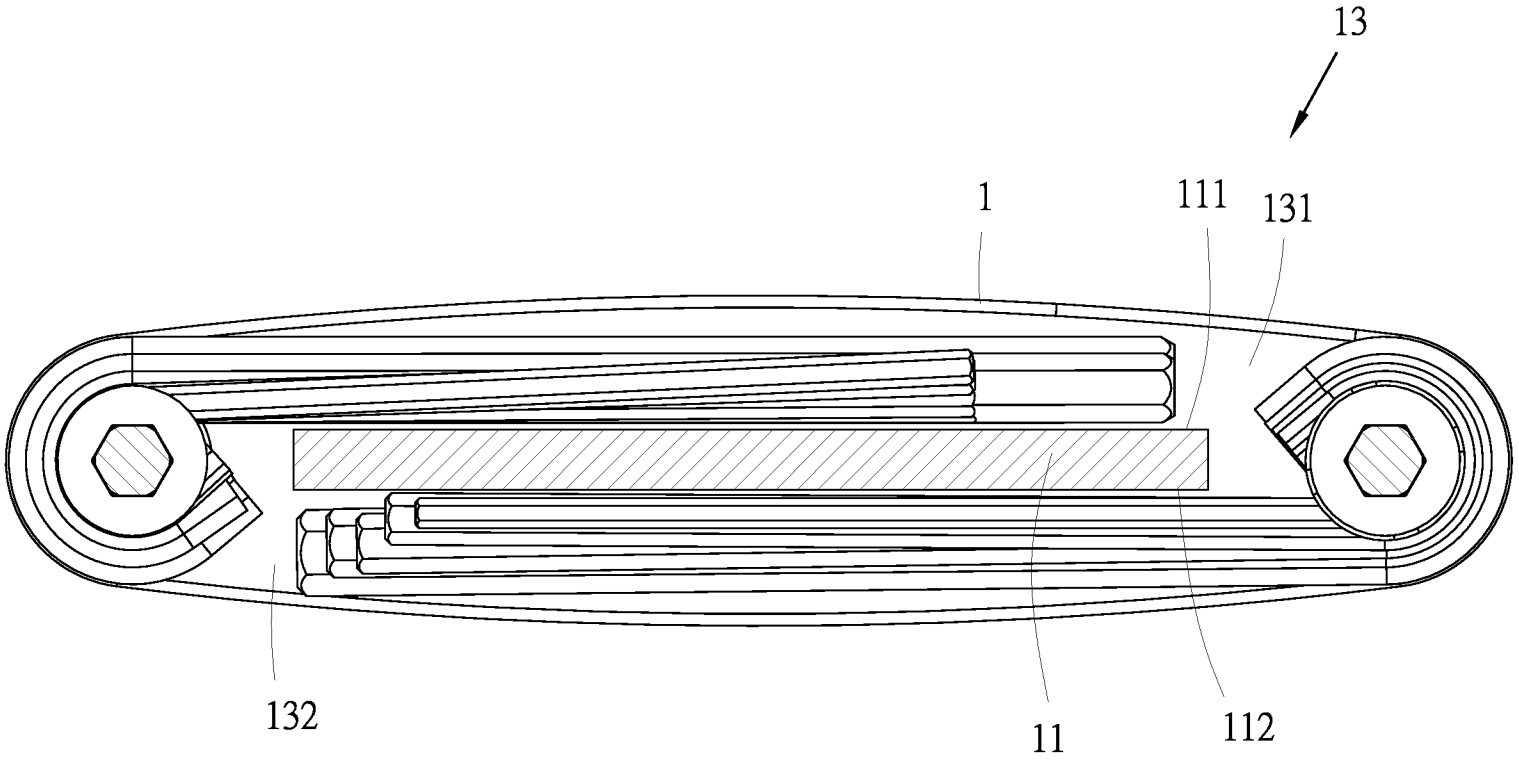
FIG. 5 is a side sectional view in accordance with the embodiment of the present invention, illustrating a first accommodating space and a second accommodating space.

Referring to FIG. 3 to FIG. 5, a folding tool set in accordance with a embodiment of the present invention comprises an accommodating seat 1, a fixing shaft 2, a plurality of tools 3, a plurality of spacers 4, a plurality of elastic members 5, and a plurality of fixing members 6.

The accommodating seat 1 includes a transverse plate 11 and two side plates 12. The side plates 12 are located at opposite sides of the transverse plate 11, respectively. The transverse plate 11 and the side plates 12 define an accommodating space 13. The side plates 12 are formed with a plurality of polygonal pivot holes 14, respectively. In this embodiment, the accommodating space 13 includes a first accommodating space 131 and a second accommodating space 132. The transverse plate 11 includes a first surface 111 and a second surface 112. The second surface 112 is opposite to the first surface 111. The first surface 111 and the side plates 12 define the first accommodating space 131. The second surface 112 and the side plates 12 define the second accommodating space 132. The polygonal pivot holes 14 each have a hexagonal shape.

The radial section of the fixing shaft 2 is polygonal. The fixing shaft 2 includes a first fixing shaft 21 and a second fixing shaft 22. The first fixing shaft 21 and the second fixing shaft 22 pass through the polygonal pivot holes 14 of the side plates 12 and are spaced apart from each other. The first fixing shaft 21 includes a first shaft 211 and a first fixing portion 212. The first shaft 211 includes a coupling end 213 and an open end 214. The second fixing shaft 22 includes a second shaft 221 and a second fixing portion 222. The second shaft 221 includes a coupling end 223 and an open end 224. The first shaft 211 passes through the side plates 12 and is perpendicular to the side plates 12. The first fixing portion 212 is blocked by one of the side plates 12. The second shaft 221 passes through the sides of the side plates 12 away from the first fixing shaft 21 and is parallel to the first shaft 211. The second fixing portion 222 is blocked by one of the side plates 12. In this embodiment, the first fixing shaft 21 and the second fixing shaft 22 are hexagonal screws. The first shaft 211 and the second shaft 221 are hollow and their radial sections are hexagonal.

One end of each tool 3 is formed with a connecting hole 31. The connecting hole 31 has a circular shape. In this embodiment, the tools 3 are hexagon rods of different specifications. In order to facilitate explanation, the tools 3 are divided into a plurality of first tools 32 and a plurality of second tools 33. The connecting holes 31 of the first tools 32 are configured for insertion of the open end 214 of the first shaft 211, so that the first tools 32 are pivotally connected to the first shaft 211 and can be movably accommodated in the first accommodating space 131. The connecting holes 31 of the second tools 33 are configured for insertion of the open end 224 of the second shaft 221, so that the second tools 33 are pivotally connected to the second shaft 221 and can be movably accommodated in the second accommodating space 132.

Each spacer 4 is formed with a through hole 41 for the open end 214 of the first shaft 211 and the open end 224 of the second shaft 221 to pass through. The spacers 4 are spaced apart from each other and disposed on the first fixing shaft 21 and the second fixing shaft 22. The spacer 4 are located between the first tools 32, between the second tools 33, between the first tools 32 adjacent to the side boards 12 and the first tools 32, and between the second tools 33 adjacent to the side plates 12 and the second tools 33 so as to separate the first tools 32 and the second tools 33 from each other. In addition, it should be noted that the through holes 41 of the spacers 4 correspond in shape to the radial sections of the first fixing shaft 21 and the second fixing shaft 22, such that the spacers 4 can be tightly fitted with the first fixing shaft 21 and the second fixing shaft 22, respectively. In this embodiment, the spacers 4 are hexagonal spacers, and the through holes 41 each have a hexagonal shape.

The elastic members 5 are disposed on the first shaft 211 and the second shaft 221, respectively. The elastic members 5 have elasticity in the axial direction of the first shaft 211 and in the axial direction of the second shaft 221, respectively. In this embodiment, the elastic members 5 are wave washers. The first shaft 211 and the second shaft 221 pass through the wave washers, respectively.

The first fixing shaft 21 and the second fixing shaft 22 pass through the side plates 12 and are coupled to the fixing members 6, respectively. One of the fixing members 6 is coupled to the open end 214 of the first shaft 211 to fix the first fixing shaft 21 and the side plates 12. The other fixing member 6 is coupled to the open end 224 of the second shaft 221 to fix the second fixing shaft 221 and the side plates 12. In this embodiment, the fixing members 6 are hexagonal screws. The radial sections of the hexagonal screws are also hexagonal. The hexagonal screws are screwed to the first shaft 211 and the second shaft 221, respectively. Therefore, after the first tools 32, the spacers 4, and the elastic members 5 are assembled on the first fixing shaft 21, the fixing member 6 and the first shaft 211 are screwed together, so that the accommodating seat 1, the first fixing shaft 21, the first tools 32, the spacers 4, the elastic member 5 and the fixing member 6 are tightly secured. Similarly, after the second tools 33, the spacers 4 and the elastic members 5 are all assembled on the second fixing shaft 22, the other fixing member 6 and the second shaft 221 are screwed together, so that the accommodating seat 1, the second fixing shaft 22, the second tools 33, the spacers 4, the elastic members 5 and the other fixing member 6 are tightly secured.

Figure 6:
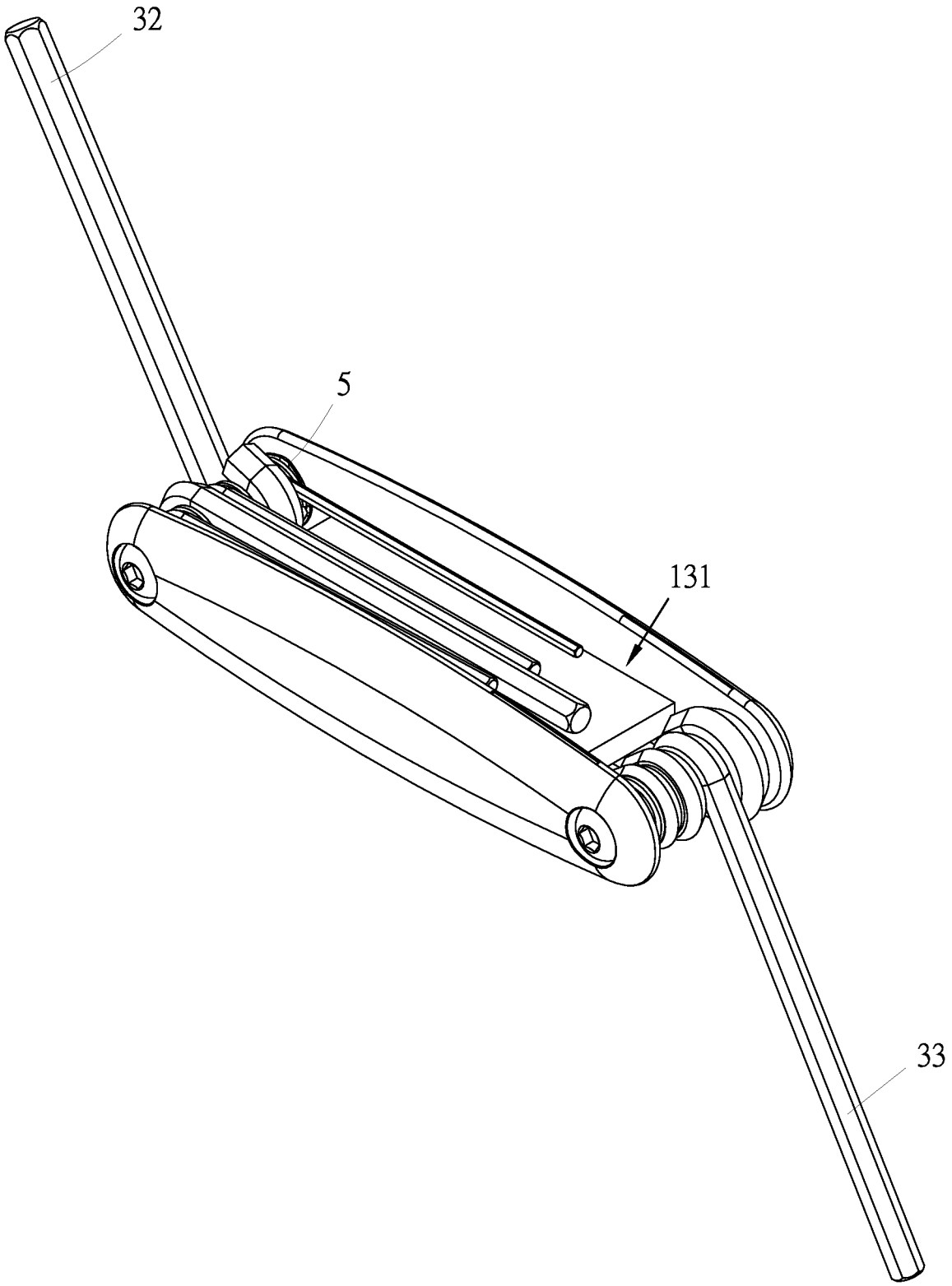
FIG. 6 is a perspective view in accordance with the embodiment of the present invention when in use.

Referring to FIG. 3 and FIG. 6, when the user pulls one of the first tools 32, the first tool 32 is pivoted to disengage from the first accommodating space 131. Because the connecting hole 31 of the first tool 32 has a circular shape different from that of the radial section of the first shaft 211 and the through holes 41 of the spacers 4, when the first tool 32 is pivoted, the connecting hole 31 of the first tool 32 is not engaged with the first shaft 211 to drive the first shaft 211 to rotate. In addition, the radial section of the first shaft 211 is hexagonal and the first shaft 211 passes through the side plates 12. Even if the first shaft 211 is applied with a force, its hexagonal side corner is engaged in the side plates 12 so as not to be rotated. The spacers 4 and the first fixing shaft 21 can be tightly fitted and engaged. When the first tool 32 is pivoted, only friction occurs with the spacers 4, and the spacers 4 cannot be driven to rotate, so that the spacers 4 provide a good separation effect. That is, the first fixing shaft 21 and the spacers 4 are all kept in a stationary state, the other first tools 32 are not affected and linked by the first tool 32 that is being pivoted.

Further, the elastic member 5 disposed on the first shaft 211 has elasticity in the axial direction of the first shaft 211. When the first tool 32 is pulled, the elastic member 5 is compressed and deformed to bring an additional space in the axial direction of the first shaft 211 so that more space is available for the first tool 32 to be pivoted smoothly. Preferably, when the first tools 32 are not pivoted, the elastic members 5 won't be deformed, so that the first tools 32, the spacers 4 and the elastic member 5 are tightly assembled to the first fixing shaft 21. The first tools 32, the spacers 4 and the elastic member 5 won't arbitrarily slide on the first fixing shaft 21.

Similarly, when the user pulls one of the second tools 33, the other second tools 33 won't be linked. The advantages of having more space and smoother pivoting are the same as the above.

It is worth mentioning that the through hole 41 of each spacer 4 can be adjusted in size during manufacture, so that each spacer 4 has a tolerance with the fixing shaft 2 according to the size of the through hole 41. When it is not easy for the user to pull the outermost tool 3, another tool 3 next to the outermost tool 3 can be pulled to link the outermost tool 3 slightly to make the pulling smoother.

It should be noted that if the tools of this embodiment are to be simplified, the tools 3 of the present invention can be accommodated only in the first accommodating space 131 or the second accommodating space 132 of the accommodating space 13.

It should be noted that if the first fixing shaft 21 and the second fixing shaft 22 have a height difference on the side plates 12, the first tools 32 and the second tools 33 are all accommodated in the first accommodating space 131 or the second accommodating space 132 of the accommodating space 13. This folding tool set of the present invention can be stored and carried with ease.

In summary, through the polygonal radial section of the fixing shaft 2 and the circular shape of the connecting holes 31, and the fixing shaft 2 is engaged with the polygonal pivot holes 14 of the side plates 12. The spacers 4 can be tightly fitted and engaged with the fixing shaft 2, respectively. When one of the tools 3 is pivoted, the fixing shaft 2 and the spacers 4 won't be influenced and driven. When one of the tools 3 is pivoted, the other tools 3 are not linked. Each spacer 4 has a tolerance with the fixing shaft 2 according to the size of the through hole 41. When it is not easy to pull the outermost tool 3, another tool 3 next to the outermost tool 3 can be pulled to link the outermost tool 3 slightly to make the pulling smoother. The elastic members 5 have elasticity. When the tool 3 is pulled, more space is available for the tool to be pivoted smoothly. The present invention solves the problem that the conventional folding tool set is inconvenient for use.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A folding tool set, comprising:

an accommodating seat, defining an accommodating space, the accommodating seat having a polygonal pivot hole defining a polygonal inner surface;

a fixing shaft, disposed on the accommodating seat and inserted through the polygonal pivot hole, the fixing shaft having a polygonal radial section with a polygonal outer surface for retentively engaging the polygonal inner surface of the polygonal pivot hole;

a plurality of tools, one end of each of the tools being formed with a connecting hole through which the fixing shaft passes, the tools being pivotally connected to the fixing shaft and movably accommodated in the accommodating space;

a plurality of spacers, spaced apart from each other and disposed on the fixing shaft, the spacers being located between the tools and between the tools adjacent to the accommodating seat and the accommodating seat, the spacers each having a polygonal through hole through which the fixing shaft passes, the polygonal through hole being congruent to the polygonal radial section of the fixing shaft; and an elastic member, disposed on the fixing shaft, the elastic member having elasticity in an axial direction of the fixing shaft.

2. The folding tool set as claimed in claim 1, wherein each of the plurality of connecting holes has a circular shape.

3. The folding tool set as claimed in claim 1, wherein the through hole of each of the plurality of spacers has a greater diameter than a maximum diameter of the polygonal radial section of the fixing shaft.

4. The folding tool set as claimed in claim 1, wherein the elastic member is a wave washer, and the fixing shaft passes through the wave washer.

5. The folding tool set as claimed in claim 1, wherein:

the accommodating seat includes a transverse plate and two side plates, the side plates being located at opposite sides of the transverse plate respectively, the accommodating space includes a first accommodating space and a second accommodating space, the transverse plate includes a first surface and a second surface, the second surface being opposite to the first surface, the first surface and the side plates defining the first accommodating space, the second surface and the side plates defining the second accommodating space, the fixing shaft includes a first fixing shaft and a second fixing shaft, the first fixing shaft and the second fixing shaft being insertedly connected to the side plates and spaced apart from each other, and the tools are divided into a plurality of first tools and a plurality of second tools, the first tools being pivotally connected to the first fixing shaft and accommodated in the first accommodating space, and the second tools being pivotally connected to the second fixing shaft and accommodated in the second accommodating space.

6. The folding tool set as claimed in claim 5, further comprising a plurality of fixing members, the first fixing shaft and the second fixing shaft passing through the side plates and being coupled to the fixing members, respectively.

7. The folding tool set as claimed in claim 1, wherein the tools are tools of different configurations.

* * * * *